US010774414B2

(12) United States Patent
Magdinier et al.

(10) Patent No.: US 10,774,414 B2
(45) Date of Patent: Sep. 15, 2020

(54) METHOD FOR SURFACE TREATMENT OF A STEEL COMPONENT BY NITRIDING OR NITROCARBURISING, OXIDISING AND THEN IMPREGNATING

(71) Applicant: H.E.F., Andrezieux Boutheon (FR)

(72) Inventors: Pierre-Louis Magdinier, Saint-Etienne (FR); Marie-Noelle Desbouche-Janny, La Fouillouse (FR)

(73) Assignee: H.E.F., Andrézieux-Bouthéon (FR)

( * ) Notice: Subject to any disclaimer, the term of this patent is extended or adjusted under 35 U.S.C. 154(b) by 359 days.

(21) Appl. No.: 15/538,005

(22) PCT Filed: Dec. 15, 2015

(86) PCT No.: PCT/FR2015/053511
§ 371 (c)(1),
(2) Date: Jun. 20, 2017

(87) PCT Pub. No.: WO2016/102813
PCT Pub. Date: Jun. 30, 2016

(65) Prior Publication Data

US 2017/0349997 A1 Dec. 7, 2017

(30) Foreign Application Priority Data

Dec. 23, 2014 (FR) ..... 1463252

(51) Int. Cl.

| | |
|---|---|
| ***C23C 8/78*** | (2006.01) |
| ***C23C 8/80*** | (2006.01) |
| ***C23C 8/02*** | (2006.01) |
| ***C23C 8/58*** | (2006.01) |
| ***C23C 8/34*** | (2006.01) |
| *C21D 1/06* | (2006.01) |

(52) U.S. Cl.
CPC ..... *C23C 8/80* (2013.01); *C23C 8/02* (2013.01); *C23C 8/34* (2013.01); *C23C 8/58* (2013.01); *C21D 1/06* (2013.01)

(58) Field of Classification Search
CPC ..... C23C 4/10; C23C 8/42–58
See application file for complete search history.

(56) References Cited

U.S. PATENT DOCUMENTS

| | | | |
|---|---|---|---|
| 5,346,560 | A | 9/1994 | Mournet et al. |
| 5,389,161 | A | 2/1995 | Wawra et al. |
| 6,645,315 | B2 | 11/2003 | Chomer et al. |
| 9,611,534 | B2 | 4/2017 | Chavanne et al. |

FOREIGN PATENT DOCUMENTS

| | | | | |
|---|---|---|---|---|
| EP | 0 053 521 | A2 | 6/1982 | |
| EP | 0 122 762 | A1 | 10/1984 | |
| EP | 0 497 663 | A1 | 5/1992 | |
| EP | 0497663 | * | 8/1992 | ..... C23C 8/80 |
| EP | 0 524 037 | A1 | 1/1993 | |
| EP | 0 560 641 | A1 | 9/1993 | |
| EP | 1 180 552 | A1 | 2/2002 | |
| KR | 100 215 252 | B1 | 8/1999 | |
| WO | 2012/146839 | A1 | 11/2012 | |

OTHER PUBLICATIONS

International Search Report, dated Mar. 10, 2016, from corresponding PCT application.

* cited by examiner

*Primary Examiner* — Lois L Zheng
(74) *Attorney, Agent, or Firm* — Nixon & Vanderhye

(57) ABSTRACT

Disclosed is a method for surface treatment of a steel component, providing high resistance to wear and corrosion, including nitriding or nitrocarburising to form a compound layer with a thickness of at least 8 micrometers made up of iron nitrides having phases ε and/or γ', oxidizing to generate a layer of oxides with a thickness of 0.1-3 micrometers, and soaking in an impregnation bath during at least 5 minutes at room temperature, the bath being made up of at least 70 wt %, ±1%, of a solvent made up of a mixture of hydrocarbons formed by a C9 to C17 alkane fraction, 10 to 30 wt %, ±1%, of at least one paraffin oil formed by a C16 to C32 alkane fraction, and at least one additive such as a synthetic phenolic additive with a concentration of 0.01 to 3 wt %, ±0.1%.

26 Claims, No Drawings

METHOD FOR SURFACE TREATMENT OF A STEEL COMPONENT BY NITRIDING OR NITROCARBURISING, OXIDISING AND THEN IMPREGNATING

BACKGROUND OF THE INVENTION

Field of the Invention

The invention concerns to a method of surface treatment of a ferrous metal part, in practice of steel or steel alloy, having good corrosion resistance by virtue of an impregnation treatment.

More generally, the invention applies to any type of mechanical part adapted to provide a mechanical function in use and required to have a high hardness, and long resistance to corrosion and wear. This is for example the case of numerous parts used in the automotive or aeronautical field.

Description of the Related Art

To improve the corrosion resistance of mechanical parts of steel, various treatments have been proposed, which comprise a nitriding or nitrocarburizing step (in baths of molten salts, or in gaseous medium), sometimes followed by a step of oxidizing and/or of depositing a finishing layer. It is to be recalled that nitriding and nitrocarburizing are thermo-chemical treatments of providing nitrogen (and respectively nitrogen and carbon) by combination-diffusion: at the surface there forms a combination layer formed from iron nitrides (several phases are possible), under which the nitrogen is present by diffusion.

Thus, document EP-0 053 521 has proposed, mainly for piston rods for which it is sought to improve the corrosion resistance and/or the coefficient of friction, a nitrocarburizing treatment adapted to form an Epsilon phase layer and a finishing treatment consisting of covering the Epsilon phase layer with a finishing layer formed from a resin (the document refers to a very broad range, encompassing acrylic resins, alkyds, maleic esters, epoxides, formaldehydes, phenolics, polyvinyl-butyral, polyvinyl chlorides, polyamides, poly-imides, polyurethanes, silicones, polyvinyl ethers and urea-formaldehydes, advantageously with filler additives chosen from zinc phosphates and chromates (to improve the corrosion resistance), and/or silicone, waxes, poly-tetra-fluoro-ethylenes, molybdenum bisulfites, graphite or zinc stearate (to reduce the coefficient of friction). No precise result is given; it is simply stated that a good example is a system of acrylic/epoxide/amino resins, containing zinc stearate or chromate or a wax.

The document EP-0 122 762 describes a method of manufacturing corrosion-resistant steel parts, comprising steps of nitriding (in Epsilon phase, as earlier), then gaseous oxidation, then application of waxy matter (Castrol V425) containing aliphatic hydrocarbons and group 2a metal soaps, preferably soaps of calcium and/or barium. The corrosion resistance in salt spray was of the order of 250 hours The Applicant has itself provided treatment methods directed to obtaining even better corrosion resistance.

In document EP-0 497 663, a method is provided consisting of subjecting ferrous metal parts to nitriding, typically in a bath of molten salts constituted by sodium, potassium and lithium cyanates, then oxidation in molten salt baths or in an oxidizing ionizing atmosphere, so as to obtain a nitrided layer comprising a deep compact sublayer and a surface layer of well-controlled porosity and lastly a deposit of a polymer of thickness comprised between 3 and 20 μm, of fluoroethylene-propylene (FEP), or even of polytetrafluoroethylene (PTFE), or even of polymers or copolymers of fluorinated or silicon-containing polyurethanes, or of polyamides-polyimides. With this method, tests have shown that the corrosion resistance was improved and enabled salt spray (SS) exposure of potentially 500 to 1000 hours approximately without any sign of corrosion appearing.

Next, by document EP-0 524 037 there has been proposed a treatment method in which the parts are nitrided preferably in baths of cyanate ion-based molten salts then oxidized and lastly impregnated with a hydrophobic wax. The nitriding followed by the oxidation leads to the formation of a layer constituted by a compact deep sublayer and a surface layer the porosity of which is well-controlled. The impregnating wax is an organic compound of high molecular weight comprised between 500 and 10000 and surface tension, in the liquid state, comprised between 10 and 73 mN/m. The contact angle between the solid phase and the surface layer and the wax in the liquid state is comprised between 0 and 75 degrees. More specifically, the wax is chosen from natural waxes, the synthetic waxes of polyethylene, polypropylene, and polyester, and fluorinated synthetic waxes, or modified petroleum residues. This solution makes it possible simultaneously to improve the corrosion resistance and the friction properties of the ferrous metal parts. The parts so treated have good corrosion resistance to standardized salt spray combined with good friction properties.

Patent EP-0 560 641 describes a process for phosphating steel parts to improve the corrosion and wear resistance making it possible to obtain specific surface characteristics resulting from a phosphating treatment preceded by a nitriding operation in a bath of molten salts containing sulfur-containing species, a nitriding operation in a bath of molten salts followed by a conventional sulfiding treatment, or by a deposition of metal followed by a conventional sulfiding operation. The values of corrosion resistance of the parts so treated, after exposure to the salt spray, are of the order of 900 to 1200 hours.

Patent EP-1 180 552 concerns a surface treatment of mechanical parts subjected both to wear and corrosion and having a roughness conducive to good lubrication and whereby nitriding is carried out by immersion between 500° C. and 700° C. of the parts in a nitriding bath of molten salts containing alkali metal carbonates and cyanates within specific ranges but free from sulfur-containing species, then oxidation is carried out in an oxidizing aqueous solution below 200° C.

Document WO2012/146839 was directed to a nitriding treatment leading to appropriate roughness without requiring a finishing treatment; it describes a bath of molten salts for nitriding mechanical parts of steel having specific amounts of alkali metal chloride, alkali metal carbonate, alkali metal cyanate and cyanide ions. The corrosion resistance measured in salt spray was comprised between 240 and 650 hours.

It is to be noted that the fact of adding a finishing treatment (deposit of a varnish or a wax, or phosphating treatment) to a nitriding or nitrocarburizing treatment then oxidizing mechanical parts of ferrous materials often enables the corrosion resistance to be improved, but generally involves a size increase complicating the obtainment, at the end of treatment, of the desired size dimensions. On a subsidiary basis, it has been found that certain finishing treatments result in the fact that the surface of the parts so treated tends to transfer a little oil onto the surfaces with which it can come into contact and has a tendency to capture the dust of the surrounding environment; this is little compatible with a complementary step such as overmolding.

BRIEF SUMMARY OF THE INVENTION

An object of the invention is to mitigate these drawbacks in a simple, safe, effective and rational manner, while attaining very high levels of resistance to corrosion as well as to wear, better than with the current impregnation baths.

To solve such a problem, a method of surface treatment of a steel mechanical part has been designed and developed to give it a high resistance to wear and to corrosion comprising:

- a step of nitriding or of nitrocarburizing adapted to form a combination layer of at least 8 micrometers thickness formed of iron nitrides of ε and/or γ' phases,
- an oxidizing step adapted to generate a layer of oxides of thickness comprised between 0.1 micrometer and 3 micrometers and
- a step of impregnating by steeping in an impregnation bath for at least 5 minutes, said bath being formed of at least 70% by weight, to the nearest 1%, of a solvent formed of a mixture of hydrocarbons formed of a set of alkanes from C9 to C17, of 10% to 30% by weight, to the nearest 1%, of at least one paraffin oil composed of a set of alkanes from C16 to C32 and of at least one additive of synthetic phenolic additive type at a concentration comprised between 0.01% and 3% by weight, to the nearest 0.1%, at ambient temperature.

It became apparent that, subject to the nitriding or the nitrocarburizing and the oxidizing have been carried out with sufficient efficacy to form the layers defined above, the impregnation in a bath in accordance with the invention leads to a substantial improvement in the corrosion resistance relative to a conventional bath, based on oils, acids and ethanol. Furthermore it has been found that, after the impregnating treatment, the parts are dry to the touch (by this is meant the absence of transfer of oil onto a counterbody surface), hence the absence of a tendency to capture the dust from the surroundings and the capability to undergo a post-treatment such as overmolding.

It is thus possible to recognize a part in accordance with the invention, obtained by the method of the invention, i.e. a steel part having a high resistance to wear and to corrosion, comprising a combination layer of at least 8 micrometers, a layer of oxides of thickness comprised between 0.1 and 3 micrometers and an impregnation layer which is dry to the touch.

The concept of ambient temperature does not designate a precise temperature but the fact that the treatment is carried out without temperature control (it is thus not necessary to heat the bath or to cool it), and that it may be carried out at the temperature induced by the surroundings, even if it varies in proportions which may be great during the course of a year, for example between 15° C. and 50° C.

Similarly, the nitriding/nitrocarburizing step is carried out such that the thickness of the combination layer obtained is at least 10 micrometers.

Advantageously, the synthetic phenolic additive is a compound of formula $C_{15}H_{24}0$.

Advantageously too, the impregnation bath further comprises at least one additive chosen from the group constituted by calcium or sodium sulfonate, phosphites, diphenylamines, zinc dithiophosphate, nitrites, phosphoramides. The amount of such additive salts is advantageously at most equal to 5%.

More particularly, the bath is, preferably, formed of 90%+/−0.5% by weight of solvent, 10%+/−0.5% by weight of paraffin oils and between 0.01% and not more than 1%+/−0.1% of synthetic phenolic additive of formula $C_{15}H_{24}O$.

Advantageously, the impregnating is carried out by steeping for a time of approximately 15 minutes.

This steeping step is advantageously followed by an operation of natural drying or drying that is accelerated by baking.

According to a first advantageous option, the nitriding/nitrocarburizing step is carried out in a bath of molten salts containing from 14% to 44% by weight of alkali metal cyanates at a temperature of 550° C. to 650° C. for at least 45 minutes; preferably, this nitriding/nitrocarburizing bath contains from 14% to 18% by weight of alkali metal cyanates. Advantageously, this treatment is carried out at a temperature of 590° C. for 90 minutes to 100 minutes; according to a variant, also advantageous, the nitriding/nitrocarburizing treatment in baths of molten salts is carried out at a temperature of 630° C. for approximately 45 minutes to 50 minutes.

According to a second advantageous option, the nitriding/nitrocarburizing step is carried out in a gaseous medium between 500° C. and 600° C. containing ammonia.

According to a third advantageous option, the nitriding/nitrocarburizing step is carried out in an ionic medium (plasma) in a medium comprising at least nitrogen and hydrogen at low pressure.

Advantageously, the oxidizing step is carried out in a bath of molten salts containing alkali metal hydroxides, nitrates and carbonates.

According to a particularly advantageous option, the oxidizing bath of molten salts contains alkali metal nitrates, alkali metal carbonates and alkali metal hydroxides. In this case, it is advantageous for the oxidizing step to be carried out at a temperature of 430° C. to 470° C. for 15 to 20 minutes.

According to another advantageous option, the oxidizing is carried out in an aqueous bath containing alkali metal hydroxides, alkali metal nitrates and alkali metal nitrites. In this case, it is advantageous for the oxidizing step to be carried out at a temperature of 110° C. to 130° C. for 15 to 20 minutes.

As a variant, the oxidizing step is carried out in a gaseous medium for the most part constituted by water vapor, at a temperature of 450° to 550° for 30 to 120 minutes.

DETAILED DESCRIPTION OF THE PREFERRED EMBODIMENTS

These various preferences arise from various tests which have been conducted, by way of illustrative non-limiting example.

More specifically, these tests were carried out by combining several types of nitriding or nitrocarburizing treatments, known per se, several types of oxidation treatment, known per se, and several types of impregnation. These tests were carried out on ferrous metal parts having smooth zones and sharp edges. More particularly, tests were carried out on fluted shafts of annealed and ground XC45 steel, having a smooth section and a threaded section.

In total, five treatments of nitriding or nitrocarburizing were tested. Three of these treatments are treatments in molten salt baths, NITRU1 to NITRU3, which correspond to examples of nitrocarburizing in accordance with the nitrocarburizing treatment taught by document EP-1 180 552 with:

the NITRU1 treatment situated in the lower range of preferred temperature and the preferred average time of treatment (from 45 minutes to 50 minutes), the NITRU2 treatment situated in that same lower range of preferred temperature but with the maximum treatment time (outside the preferred zone, i.e. from 90 minutes to 100 minutes) and the NITRU3 treatment situated in the higher range of preferred temperature with the preferred average time of treatment (from 45 minutes to 50 minutes). The parameters of these treatments are set out in table 1 below.

| | Amount of CN in % (by weight) | Amount of CNO in % (by weight) | Temperature (in ° C.) | Treatment time (in minutes) | Thickness of treatment layer (in micrometers) |
|---|---|---|---|---|---|
| NITRU 1 | 1 to 3 | 14 to 18 | 590 | >=45 | <8 |
| NITRU 2 | 1 to 3 | 14 to 18 | 590 | >=90 | >8 |
| NITRU 3 | 1 to 3 | 14 to 18 | 630 | >=45 | >8 |

More generally, it may be noted that the NITRU1 treatment leads to a combination layer of thickness less than 8 micrometers, whereas the NITRU2 and NITRU3 treatments lead to a layer of which the thickness exceeds this threshold, and is even preferably of at least 10 micrometers techniques. It would appear unnecessary, in practice, to seek to exceed 25 micrometers, such that an effective range for the thickness of the layer appears to be from 10 to 25 micrometers.

In general, these three treatments correspond to a treatment in a bath of molten salts containing from 14% to 44% by weight of alkali metal cyanates (preferably from 14% to 18%) at a temperature of 550° C. to 650° C. (preferably, from 590° C. to 630° C.) for at least 45 minutes (it would not appear useful to exceed 120 minutes, or even 90 minutes).

Another of these treatments is a conventional treatment in gaseous medium, NITRU4 (aiming for a combination layer thickness of at least 8 μm and advantageously comprised between 10 and 25 μm), and another of these treatments is a conventional treatment in an ionic medium (plasma), NITRU5 ((aiming for a combination layer thickness of at least 8 μm and advantageously comprised between 10 and 25 μm).

More specifically, the NITRU4 treatment in gaseous medium was made in an oven between approximately 500 and 600° C. under a controlled atmosphere comprising ammonia. The treatment time was established to ensure a combination layer thickness of at least 8 micrometers, preferably greater than 10 micrometers.

As for the NITRU5 treatment, this was carried out in an ionic medium (plasma) in a mixture comprising at least nitrogen and hydrogen, at low pressure (that is to say at a pressure less than atmospheric pressure, typically less than 0.1 atmospheres). The treatment time was also established to ensure a combination layer thickness of at least 8 micrometers, preferably at least 10 micrometers.

In the above, the thickness of treatment layer indicated does not take into account the diffusion layer (for the nitrogen as well as for the carbon).

According to these various nitriding/nitrocarburizing treatments, different combination layers have been obtained:

either with nitrides in ε phase ($Fe_{2-3}N$), or nitrides in ε and γ' phases ($Fe_{2-3}N+Fe_4N$) with salt baths NITRU1 to NITRU3.

nitrides in ε and γ' phases ($Fe_{2-3}N+Fe_4N$) with the treatment in gaseous phase NITRU4, nitrides in ε and γ' phases ($Fe_{2-3}N+Fe_4N$) with the treatment in plasma phase NITRU5.

Only the treatments NITRU2 to NITRU5 resulted in combination layer thicknesses of at least 8 micrometers, advantageously between 10 and 25 micrometers.

For each of the 5 nitriding treatments NITRU1 to NITRU5, three types of oxidizing treatments were implemented:

1) "Type 1" oxidation (or Ox1), that is to say in an ionic liquid medium containing $NaNO_3$ (between 35 and 40% by weight), carbonates (of Li, of K, of Na) (between 15 and 20% by weight), NaOH (between 40 and 45% by weight)—temperature of 450° C.—treatment time of 15 minutes.

2) "Type 2" oxidation (or Ox2), that is to say in an aqueous medium containing KOH (between 80% and 85% by weight), $NaNO_3$ (between 10% and 15% by weight) and $NaNO_2$ (between 1 and 6% by weight)—temperature of 120° C.—treatment time of 15 minutes.

3) "Type 3" oxidation (or Ox3), in a gaseous medium (treatment in water vapor)—temperature of 500° C.—treatment time of 60 minutes.

The Ox1 and Ox2 oxidations substantially correspond, respectively, to the oxidation in a salt bath and to the aqueous oxidation of the aforementioned document EP1180552, whereas the treatment parameters for nitrocarburizing (NITRU5) and oxidation Ox3, in an ionized medium, substantially correspond to Example 9 of document EP0497663.

The oxidations were carried out so as to obtain oxidation layers of thickness comprised between 0.1 and 3 micrometers.

Lastly, after the oxidation operation, two types of impregnation were carried out.

1) a new impregnation designated "impregnation 1" (or Imp1) in a bath mainly containing a solvent (90%+/−0.5% by weight) formed of a mixture of hydrocarbons composed of a set of alkanes from C9 to C17, 10%+/−0.5% by weight, a paraffin oil composed of a set of alkanes from C16 to C32 and between 0.1% and 1%+1-0.1% of a synthetic phenolic additive of formula $C_{15}H_{24}O$. This impregnation was made by steeping for approximately 15 minutes of immersion, followed by natural drying or drying that is accelerated by baking.

2) A conventional impregnation designated "impregnation 2" (or Imp2), in a bath containing mainly oils (between 60 and 85% by weight), acids (between 6 and 15% by weight) and ethanol (between 1 and 5% by weight). This impregnation was made by steeping for approximately 15 minutes of immersion, followed by natural drying or drying that is accelerated by baking.

By combining the types of oxidation and the types of impregnation, 8 treatments have been defined, denoted 1 to 8, in accordance with the following table (an absence of oxidation is designated by "Ox0").

| | Oxidation type | Impregnation type |
|---|---|---|
| Treatment 1 | Ox1 | Imp2 |
| Treatment 2 | Ox1 | Imp1 |
| Treatment 3 | Ox2 | Imp2 |
| Treatment 4 | Ox2 | Imp1 |
| Treatment 5 | Ox3 | Imp2 |
| Treatment 6 | Ox3 | Imp1 |
| Treatment 7 | Without oxidation (Ox0) | Imp2 |
| Treatment 8 | Without oxidation (Ox0) | Imp1 |

Samples were prepared by combining these treatments 1 to 8 with the aforementioned nitriding/nitrocarburizing treatments. Tests of corrosion resistance were carried out according to the standard ISO 9227 (2006) in salt spray. The results are summarized in the table below: For each test, a minimum of 10 parts were tested The time (indicated in hours) corresponds to a total lack of any traces of corrosion on 100% of the parts.

It became apparent that impregnation treatment 1 did not lead to any dimensional variation. What is more, the surface of the parts was dry to the touch; this implies that the surface of these parts does not have a tendency to capture dust and also implies that these parts are compatible with a post-treatment such as overmolding.

| | Without nitriding | NITRU 1 | NITRU 2 | NITRU 3 | NITRU 4 | NITRU 5 |
|---|---|---|---|---|---|---|
| Treatment 1 Ox1 + Imp2 | 96 h | 360 h | 912 h | 792 h | 384 h | 72 h |
| Treatment 2 Ox1 + Imp1 | 96 h | 960 h | 1368 h | 1368 h | 1008 h | 576 h |
| Treatment 3 Ox2 + Imp2 | 96 h | 312 h | 576 h | 792 h | 504 h | 72 h |
| Treatment 4 Ox2 + Imp1 | 96 h | 360 h | 1056 h | 1056 h | 720 h | 360 h |
| Treatment 5 Ox3 + Imp2 | 96 h | 192 h | 456 h | 552 h | 312 h | 24 h |
| Treatment 6 Ox3 + Imp1 | 96 h | 264 h | 888 h | 792 h | 552 h | 72 h |
| Treatment 7 Ox0 + Imp2 | 96 h | 96 h | 456 h | 384 h | 48 h | 48 h |
| Treatment 8 Ox0 + Imp1 | 96 h | 120 h | 504 h | 624 h | 360 h | 336 h |

This table shows first of all that the new impregnation treatment (impregnation 1—even-numbered treatments) provides an appreciable improvement relative to the case of a conventional impregnation (impregnation 2—odd-numbered treatments).

It may be noted that the oxidation-impregnation treatment matters little when there is no nitriding/nitrocarburizing (the corrosion resistance remains at 96 h, in the first column).

Treatment NITRU5 tends to show that the impregnation 2 treatment (conventional) results in a corrosion resistance lower than the case without any nitriding.

The advantage of the type 1 impregnation can be seen in particular in the case of the nitrocarburizing NITRU5 since, with the case of the oxidation 3 (in gaseous medium—treatments 5 and 6), the improvement is of the order of a tripling of the corrosion resistance (increase by about fifty hours) relative to the case of a conventional impregnation; this is however the case in which the oxidation has a particularly negative effect.

In all the other NITRU5 cases, the increase in the corrosion resistance is at least of the order of 200 hours. Thus, in the case of NITRU5 combined with the oxidation in an aqueous medium (oxidation 2—treatments 3 and 4) or in the absence of oxidation (treatments 7 and 8), the new impregnation results in an increase in the corrosion resistance of the order of 300 hours; in the case of NITRU5 combined with the oxidation in an ionic liquid medium (oxidation 1—treatments 1 and 2), the increase is even of the order of 500 hours.

As regards the treatment NITRU1, it may be noted that the beneficial effect of the new impregnation exists but is moderate, including in percentage, relative to the conventional impregnation (treatments 3 to 8, even though the capabilities to withstand corrosion, in absolute value, are better than with NITRU5). However, a very great increase may be noted, of 600 hours, in the case of an oxidation in an ionic medium (treatments 1 and 2), with a corrosion resistance approaching the threshold of 1000 hours. It seems to be possible to deduce therefrom that the condition of a combination layer of at least 8 micrometers thickness may be lowered in the case of an oxidation of type 1.

Considering now the treatment NITRU4, it leads to the same comment as the NITRU5 treatment in the absence of oxidation (treatments 7 and 8). On the other hand an increase is found of at least 200 hours of corrosion resistance in the case of the oxidations of type 2 (in an aqueous medium—treatments 3 and 4) and of type 3 (in gaseous medium—treatments 5 and 6). A quite remarkable increase is however observed in the case of an oxidation of type 1 (oxidation in an ionic medium at high temperature—treatments 1 and 2), since the corrosion resistance is improved by nearly 600 hours while exceeding the threshold of 1000 hours.

Considering now the treatments of nitriding/nitrocarburizing in baths of molten salts in which care has been taken to obtain a combination layer of at least 8 micrometers thickness (or even 10 micrometers), it is found that the new impregnation leads to particularly high levels of the corrosion resistance.

In the case of an absence of oxidation, the new impregnation provides an improvement, especially significant in the case of NITRU3.

In the presence of an oxidation, the improvement in the corrosion resistance is, for the oxidations of type 2 and 3 (treatments 3 to 6) at least 250 hours for the NITRU3 treatment and even 450 hours for the NITRU2 treatment. With the type 2 oxidation (treatments 3 and 4) corrosion resistances exceeding the threshold of 1000 hours are obtained.

With the oxidation of type 1 (particularly 1 and 2), the increase provided by the new impregnation is astonishingly high, since it is 456 hours for NITRU2 and even 576 h for NITRU3 to attain a particularly high threshold, of the order of 1370 h.

Thus, it appears that:

- the new impregnation provides an improvement to the corrosion resistance relative to a conventional impregnation, whatever the treatments of nitriding/nitrocarburizing and oxidation.
- This improvement is particularly notable and leads to values of corrosion resistance that are particularly high for the nitrocarburizing treatments in baths of salts leading to a combination layer of at least 8 micrometers (NITRU2 and NITRU3), preferably between 10 and 25 micrometers,
- This improvement is particularly notable and leads to values of corrosion resistance that are particularly high for the nitrocarburizing in salt baths (NITRU1 to NITRU3) or in gaseous phase (NITRU4) in the case of an oxidation in molten salts baths (type 1),
- This improvement results in particularly high levels of corrosion resistance by combining the nitrocarburizing in salt baths leading to a layer of at least 8 micrometers thickness (NITRU2 and NITRU3) and an oxidation of type 1 or 2, especially in the case of an oxidation in a salt bath (type 1).

The above results were measured on smooth zones of the samples.

Measurements on zones presenting asperities (threaded zones in this case) also showed that better results are obtained with the oxidation treatments in liquid medium 1 and 2, combined with impregnation of type 1 and with nitrocarburizing in salt baths leading to combination layers of at least 8 micrometers, NITRU2 and NITRU3.

Whereas the new impregnation yields excellent results, equivalent for NITRU2 and NITRU3, with the oxidation in a liquid medium, on smooth surfaces, it seems that, on zones that are not smooth, the new impregnation gives very good results for these same two types of nitrocarburizing, a little better with NITRU3 than with NITRU2.

In summary, the above results show that the impregnation 1 bath has a surprising effect of synergy with the NITRU2 and NITRU3 treatments of nitriding/nitrocarburizing provided that the nitriding/nitrocarburizing be followed by a type 1 or 2 oxidation, an optimum seeming to be obtained when the oxidation treatment is of type 1.

The extent of the increases in corrosion resistance found for the combination of the impregnation bath 1 with the nitriding/nitrocarburizing treatments in baths of molten salts results in combination layers of more than 8 micrometers thickness (NITRU2 and NITRU3) and the oxidation 1 treatment in a bath of molten salts results from the existence of a surprising synergy between these three types of treatment which is still not understood.

The particular composition of an impregnation considered in the tests enters into a more general composition, i.e. a bath formed of at least 70% by weight, to the nearest 1%, of a solvent formed of a mixture of hydrocarbons formed of a set of alkanes from C9 to C17, of 10% to 30% by weight, to the nearest 1%, of at least one paraffin oil composed of a set of alkanes from C16 to C32 and of at least one additive of synthetic phenolic additive type at a concentration comprised between 0.01% and 3% by weight, at ambient temperature.

The amount of solvent is preferably comprised between 80% and 90% by weight, similarly, the amount of paraffin oil is preferably comprised between 10% and 20% by weight. The set of alkanes of the solvent is preferably from C9 to C14.

The aforementioned results have been obtained on the basis of XC45 steel samples, but it is within the capability of the person skilled in the art to adapt the treatment parameters according to the material used, and thereby follow the aforementioned teaching.

The invention claimed is:

1. A method of surface treatment of a steel part to give it a high resistance to wear and to corrosion comprising a step of nitriding or of nitrocarburizing adapted to form a combination layer of at least 8 micrometers thickness formed of iron nitrides of ε and/or γ' phases, an oxidizing step adapted to generate a layer of oxides of thickness comprised between 0.1 and 3 micrometers and a step of impregnating by steeping in an impregnation bath for at least 5 minutes, said bath being formed of at least 70% by weight, to the nearest 1%, of a solvent formed of a mixture of hydrocarbons formed of a set of alkanes from C9 to C17, of 10% to 30% by weight, to the nearest 1%, of at least one paraffin oil composed of a set of alkanes from C16 to C32 and of at least one additive of synthetic phenolic additive type at a concentration comprised between 0.01% and 3% by weight, to the nearest 0.1%, at ambient temperature.

2. A method according to claim 1, wherein the synthetic phenolic additive is a compound of formula $C_{15}H_{24}O$.

3. A method according to claim 2, wherein the impregnation bath is formed of 90%+/−0.5% by weight of solvent, 10%+/−0.5% by weight of paraffin oils and between 0.01% and less than 1%+/−0.1%, of synthetic phenolic additive of formula $C_{15}H_{24}O$.

4. A method according to claim 1, wherein the impregnation bath further comprises at least one additive chosen from the group constituted by calcium or sodium sulfonate, phosphites, diphenylamines, zinc dithiophosphate, nitrites, phosphoramides.

5. A method according to claim 1, wherein the steeping operation is followed by an operation of natural drying or drying that is accelerated by baking.

6. A method according to claim 1, wherein the nitriding or nitrocarburizing step is carried out in a bath of molten salts containing from 14% to 44% by weight of alkali metal cyanates at a temperature of 550° C. to 650° C. for at least 45 minutes.

7. A method according to claim 6, wherein the nitriding/nitrocarburizing bath contains from 14% to 18% by weight of alkali metal cyanates.

8. A method according to claim 6 wherein the nitriding/nitrocarburizing treatment is carried out at a temperature of 590° C. for 90 minutes to 100 minutes.

9. A method according to claim 6 wherein the nitriding/nitrocarburizing treatment is carried out at a temperature of 630° C. for approximately 45 minutes to 50 minutes.

10. A method according to claim 1, wherein the nitrocarburizing step is carried out in a gaseous medium between 500° C. and 600° C. containing ammonia.

11. A method according to claim 1, wherein the nitriding or nitrocarburizing step is carried out in an ionic medium forming a plasma, comprising at least nitrogen and hydrogen at low pressure.

12. A method according to claim 1, wherein the nitriding or nitrocarburizing step is carried out so as to form a combination layer of thickness at least 10 micrometers.

13. A method according to claim 1, wherein the oxidizing step is carried out in a bath of molten salts which contains alkali metal nitrates, alkali metal carbonates and alkali metal hydroxides.

14. A method according to claim 13, wherein the oxidizing step is carried out at a temperature of 430° C. to 470° C. for 15 to 20 minutes.

15. A method according to claim 1, wherein the oxidizing step is carried out in an aqueous bath which contains alkali metal hydroxides, alkali metal nitrates and alkali metal nitrites.

16. A method according to claim 15, wherein the oxidizing step is carried out at a temperature of 110° C. to 130° C. for 15 to 20 minutes.

17. A method according to claim 1, wherein the oxidizing step is carried out in a gaseous medium for the most part constituted by water vapor, at a temperature of 450° to 550° for 30 to 120 minutes.

18. A method according to claim 2, wherein the impregnation bath further comprises at least one additive chosen from the group constituted by calcium or sodium sulfonate, phosphites, diphenylamines, zinc dithiophosphate, nitrites, phosphoramides.

19. A method according to claim 3, wherein the impregnation bath further comprises at least one additive chosen from the group constituted by calcium or sodium sulfonate, phosphites, diphenylamines, zinc dithiophosphate, nitrites, phosphoramides.

20. A steel part having a high resistance to wear and to corrosion, the steel part comprising:

a combination layer of at least 8 micrometers;

a layer of oxides of thickness comprised between 0.1 and 3 micrometers; and an impregnation layer which is dry to the touch, the impregnation layer comprising at least one synthetic phenolic additive.

21. The steel part according to claim 20, wherein the combination layer is formed of iron nitrides of ε and/or γ' phases.

22. The steel part according to claim 20, wherein the combination layer has a thickness of at least 10 micrometers.

23. The steel part according to claim 22, wherein the combination layer has a thickness comprised between 10 μm and 25 μm.

24. The steel part according to claim 20, wherein the impregnation layer comprises at least one paraffin oil composed of a set of alkanes from C16 to C32.

25. The steel part according to claim 20, wherein the at least one synthetic phenolic additive is represented by formula $C_{15}H_{24}O$.

26. The steel part according to claim 20, wherein the impregnation layer further comprises at least one additive selected from the group consisting of calcium sulfonate, sodium sulfonate, phosphites, diphenylamines, zinc dithiophosphate, nitrites, and phosphoramides.

* * * * *